United States Patent [19]

Blatter

[11] 4,158,352

[45] Jun. 19, 1979

[54] APPARATUS FOR PROVIDING ADDITIONAL AIR TO AID STARTING OF I.C. ENGINES

[75] Inventor: Albert Blatter, Southfield, Mich.

[73] Assignee: The Bendix Corporation, Southfield, Mich.

[21] Appl. No.: 838,192

[22] Filed: Sep. 30, 1977

[51] Int. Cl.[2] ..... F02M 7/12

[52] U.S. Cl. ..... 123/119 DB; 123/97 B; 123/119 D; 123/124 R; 123/179 G

[58] Field of Search ..... 123/124 R, 119 D, 119 DB, 123/97 B, 179 G

[56] References Cited

U.S. PATENT DOCUMENTS

| | | | |
|---|---|---|---|
| 2,883,112 | 4/1959 | Stoltman | 123/119 X |
| 2,889,820 | 6/1959 | Grozinger | 123/124 R |
| 3,199,498 | 8/1965 | Schultssey | 123/97 B |
| 3,460,814 | 8/1969 | O'Neill | 123/97 B X |
| 3,530,841 | 9/1970 | Haft et al. | 123/124 R |

*Primary Examiner*—Wendell E. Burns

*Attorney, Agent, or Firm*—Gaylord P. Haas, Jr.; Russel C. Wells

[57] ABSTRACT

A method and apparatus for introducing additional air into the intake manifold to aid in the starting of an internal combustion engine. A flapper valve is provided on the throttle valve which is operative according to the pressure differential across the flapper valve blade.

3 Claims, 2 Drawing Figures

APPARATUS FOR PROVIDING ADDITIONAL AIR TO AID STARTING OF I.C. ENGINES

BACKGROUND OF THE INVENTION

1. FIELD OF THE INVENTION

The invention is directed to throttle valves used in a conventional internal combustion engine for introducing additional air into the intake manifold during cranking.

2. DESCRIPTION OF THE PRIOR ART

In most conventional internal combustion engines, a quantity of air is introduced into the intake manifold before ignition through the process of "cranking" the engine, by alternately depressing and releasing the accelerator pedal thereby entraining fuel in the resultant flow of air through the open throttle plate and past the throttle plate when closed. This pedal is connected to the throttle valve through the appropriate linkages and opens in response to the pedal position, thereby allowing air to flow between the throttle valve and the throttle body bore, and into the intake manifold. While this system ultimately introduces sufficient air to start the engine, it would be advantageous to provide a throttle valve which would automatically introduce a greater amount of air during cranking, and then close and introduce the same amount of air to the intake manifold as would a conventional throttle at a particular throttle position. This system would preferably include a flapper valve mounted on the throttle, said flapper valve opening and closing a hole in the throttle plate in response to the pressure differential across the valve.

The prior art is replete with carburetors employing throttle valves of different configurations containing holes therein for specific purposes. One such carburetor is shown in U.S. Pat. No. 2,080,440 issued to H. T. Scott. This patent shows a throttle valve formed with equidistantly spaced minute orifices to ensure complete atomization or pulverization of the fuel and to prevent the movement of globules of fuel past the throttle valve and into the intake manifold.

Another carburetor of note is shown in U.S. Pat. No. 3,437,320 issued to Brooks Walker and Frank W. Kertell. This patent describes a butterfly valve containing at least one aperture therein for providing air for idling when the valve is closed. This particular butterfly valve configuration may be used to reduce smog-producing components in the exhaust of an internal combustion engine.

German Pat. No. 433,083 shows a throttle valve having a hole in one side. A flapper valve having a larger diameter than the throttle valve is connected to said throttle valve and is capable of movement toward and away from the hole in cooperation with the air flow and a flow line.

U.S. Pat. No. 3,907,944 issued to Masahiko Nakada describes a choke control system for internal combustion engines including a diaphragm box having a liquid chamber bisected by a partition wall. The box is connected to a choke valve by a rod, with the wall containing an orifice and a check valve. When the check valve is in its opened position as shown in FIG. 2, no vacuum is applied in the diaphragm chamber. When the valve is in its closed condition (FIG. 3), vacuum does act in the diaphragm chamber. It should be noted, however, this check valve is arranged to be opened or closed in accordance with the operating temperature conditions of the engine.

Other references showing carburetor throttles are U.S. Pat. Nos. 2,658,734; 3,298,677; 3,523,680; and 3,759,489.

Therefore, a review of prior art has failed to uncover, and the inventor is unaware of, a reference showing a flapper blade attached to a throttle valve which is closed when a pressure differential occurs across the blade.

SUMMARY OF THE INVENTION

Briefly, the present invention is directed to a throttle blade having a hole therein. A flapper valve is mounted on the blade and is preformed to be in the open position when the engine is cranked prior to starting. When the engine starts, the manifold pressure will rapidly drop and the large pressure differential across the flapper will close the hole and normal idle vapor flow will occur. This particular configuration of the throttle-flapper valve construction will provide additional air during cranking of the engine.

DESCRIPTION OF THE DRAWINGS

The above and additional objects and advantages inherent in the present invention will become more apparent by reference to the description of an illustrated embodiment in the drawing thereof in which.

DETAILED DESCRIPTION

Figure 1:
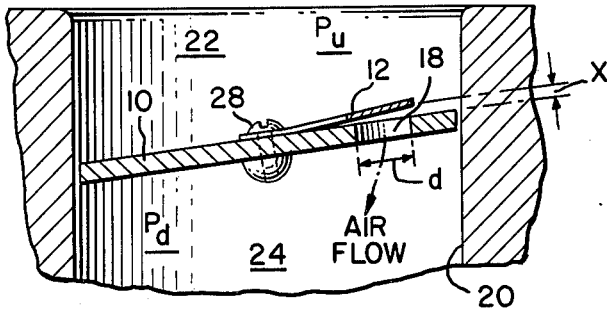
FIG. 1 is a sectional view of the throttle-flapper valve combination installed in the throttle body taken through 1—1 in FIG. 2.
Figure 2:
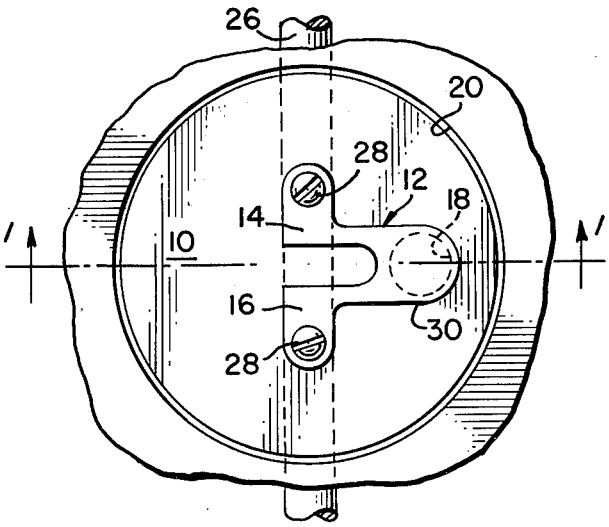
FIG. 2 is a plan view of the throttle-flapper blade assembly.

As shown in FIGS. 1 and 2, the throttle valve of the present invention contains a conventional butterfly-like throttle blade 10 which is substantially circular or oval in configuration. The throttle valve is pivotally disposed in the throttle bore 20 of a standard internal combustion engine. The blade is attached to the accelerator by the appropriate accelerator linkage through throttle shaft 26, and opens and closes to allow air alone, or an air/fuel mixture to flow into the intake manifold.

A flapper valve 12 having flexible arms 14, 16 and a body portion 30 is mounted on the throttle blade 10 so that it can open and close a hole 18 present on the blade. The flapper valve 12 is constructed of a thin spring sheet material or of metal on plastic and may be preformed to be in the open position as shown in FIG. 1. Alternatively, the valve 12 can be spring loaded into the open position by action of the driver through suitable state-of-the-art linkages.

The flapper valve 12 may be intalled directly onto the valve blade 10 and throttle shaft 26 through the use of attachment screws 28 as shown in FIG. 2. Alternatively, the flapper 12 may be mounted entirely on the throttle blade 10. The hole 18 in blade 10 may be of any convenient shape or design.

In operation, during cranking of the engine, the flapper valve 12 is in its preformed open position allowing air to pass around the throttle blade 10 as well as through the hole 18 as shown in FIG. 1. Since the ambient pressure Pu in section 22 is roughly equal to the manifold pressure Pd in section 24, the flapper valve remains in the open position. During cranking, the pressure reduction in the manifold is very slight, being in the range of 30mm Hg. By selecting the appropriate hole diameter d, flapper opening x and spring rate of the flapper flexural arms 14, 16, the flapper valve remains open during cranking and allows the desired additional air to pass into the intake manifold.

When the engine starts, the manifold pressure Pd will rapidly drop and the large pressure differential across the flapper will close the body portion 30 of the flapper valve over the hole 18 and normal idle air flow will occur.

The flapper valve 12 and hole porportions 18 are of such valve that the flapper will stay closed up to large throttle openings or relatively low manifold vacuum before it will open when the engine is operating. The incremental flow change in the induction vapor flow is very small and is not noticeable to the driver.

Obviously, many modifications and variations of the present invention are possible in light of the above teachings. It is therefore understood that within the scope of the appended claims, the invention may be incorporated in other forms specifically described.

What is claimed is:

1. A throttle valve control for providing additional air to the cylinders of an internal combustion engine during cranking of the engine comprising:

a throttle body including means forming a bore;

a throttle blade disposed in said throttle body bore for controlling the supply of air to the engine and having means thereon forming an aperture hole through said blade; and valve means movably secured relative to said throttle blade, said valve means having a normally open position and a closed position and being operative to change between said open and closed positions in response to a pressure differential across said throttle blade, said open position permitting air flow through said hole into the intake manifold and entrain fuel in said air flow during cranking of the engine, and precluding air from flowing through said hole upon starting of the engine when the manifold pressure reduces from ambient pressure to move said valve means to the closed position.

2. A throttle valve control in accordance with claim 1, wherein said valve means is resiliently secured to said throttle blade.

3. A throttle valve control in accordance with claim 1 wherein said valve means is a flapper valve having a portion thereof overlying said aperture, said flapper valve closing said aperture.

* * * * *